US008006772B2

(12) United States Patent
Nazir et al.

(10) Patent No.: US 8,006,772 B2
(45) Date of Patent: Aug. 30, 2011

(54) MULTI-CYCLE ISOLATION VALVE AND MECHANICAL BARRIER

(75) Inventors: Samir Nazir, Houston, TX (US); Alfredo Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 410 days.

(21) Appl. No.: 12/100,936

(22) Filed: Apr. 10, 2008

(65) Prior Publication Data

US 2009/0255685 A1 Oct. 15, 2009

(51) Int. Cl.
*E21B 34/14* (2006.01)

(52) U.S. Cl. ..... 166/386; 166/332.4; 166/332.8

(58) Field of Classification Search ..... 166/386, 166/332.4, 332.8, 323
See application file for complete search history.

(56) References Cited

U.S. PATENT DOCUMENTS

| | | | | |
|---|---|---|---|---|
| 5,253,712 | A * | 10/1993 | Swor | 166/330 |
| 5,372,193 | A | 12/1994 | French | |
| 5,641,023 | A * | 6/1997 | Ross et al. | 166/386 |
| 5,823,265 | A | 10/1998 | Crow et al. | |
| 6,152,224 | A | 11/2000 | French | |
| 6,220,355 | B1 | 4/2001 | French | |
| 6,230,808 | B1 | 5/2001 | French et al. | |
| 6,286,594 | B1 | 9/2001 | French | |
| 6,289,991 | B1 | 9/2001 | French | |
| 6,315,041 | B1 | 11/2001 | Carlisle et al. | |
| 6,328,109 | B1 | 12/2001 | Pringle et al. | |
| 6,394,187 | B1 * | 5/2002 | Dickson et al. | 166/383 |
| 6,478,090 | B2 * | 11/2002 | Deaton | 166/363 |
| 6,494,269 | B2 | 12/2002 | French et al. | |
| 6,523,613 | B2 * | 2/2003 | Rayssiguier et al. | 166/320 |
| 6,575,249 | B2 | 6/2003 | Deaton | |
| 6,684,950 | B2 | 2/2004 | Patel | |
| 6,904,975 | B2 * | 6/2005 | Horne et al. | 166/386 |
| 7,137,452 | B2 * | 11/2006 | McVicker | 166/373 |
| 7,150,326 | B2 * | 12/2006 | Bishop et al. | 166/373 |
| 7,287,596 | B2 * | 10/2007 | Frazier et al. | 166/332.8 |
| 7,387,165 | B2 * | 6/2008 | Lopez de Cardenas et al. | 166/313 |
| 7,624,809 | B2 * | 12/2009 | Frazier et al. | 166/386 |
| 7,673,689 | B2 * | 3/2010 | Jackson et al. | 166/332.8 |
| 2002/0070028 | A1 | 6/2002 | Garcia et al. | |
| 2003/0173091 | A1 | 9/2003 | Horne et al. | |
| 2004/0035586 | A1 * | 2/2004 | Gudmestad et al. | 166/373 |

(Continued)

FOREIGN PATENT DOCUMENTS

WO WO 03054347 A1 * 7/2003

*Primary Examiner* — Jennifer H Gay
(74) *Attorney, Agent, or Firm* — Mossman, Kumar & Tyler, PC

(57) ABSTRACT

A method for performing a wellbore-related activity may include positioning a sealing device along the wellbore; conveying a work string into the wellbore; using the work string to perform the activity; extracting the work string out of the wellbore; and shifting the sealing device to a closed position to seal a bore of the wellbore using a portion of the work string. A device that selectively seals or occludes a wellbore tubular may include a sealing device having a first and a second sealing element that seal a bore of the wellbore tubular. The first and second sealing elements may support a pressure applied in different directions. Pulling an engagement sleeve with the work string in an uphole direction may fold the first and second sealing elements into the closed position. The bore may be unsealed by applying a pressure cycle to shift the sealing device.

10 Claims, 4 Drawing Sheets

U.S. PATENT DOCUMENTS

2005/0178562 A1 8/2005 Livingstone
2006/0213670 A1* 9/2006 Bishop et al. ..... 166/386
2007/0215361 A1* 9/2007 Pia ..... 166/386
2007/0272411 A1* 11/2007 Lopez De Cardenas et al. ..... 166/305.1
2007/0284119 A1* 12/2007 Jackson et al. ..... 166/386
2009/0229829 A1* 9/2009 Lloyd et al. ..... 166/330
2009/0230340 A1* 9/2009 Purkis ..... 251/228
2009/0255685 A1* 10/2009 Nazir et al. ..... 166/373
2009/0272539 A1* 11/2009 Lloyd et al. ..... 166/373

* cited by examiner

MULTI-CYCLE ISOLATION VALVE AND MECHANICAL BARRIER

CROSS-REFERENCE TO RELATED APPLICATIONS

None.

BACKGROUND OF THE DISCLOSURE

1. Field of the Disclosure

The present disclosure relates to oilfield downhole operations.

2. Description of the Related Art

Hydrocarbons, such as oil and gas, are typically recovered from subterranean formations via one or more wellbores that intersect such formations. After being drilled, a wellbore or "borehole," may be completed using tubulars such as casing that are cemented in place. Additionally, a variety of additional equipment or tooling may be installed in the wellbore, such as screens, gravel packs, packer elements, and the like. Tools and equipment that are used downhole may employ a variety of actuation schemes and utilize a broad range of operating principles. Thus, there is a continual need to provide devices and methods that enable such tools and equipment to be deployed efficiently, despite their operational differences.

SUMMARY OF THE DISCLOSURE

In aspects, the present disclosure provides a method of performing one or more wellbore-related activities. In one embodiment, the method may include positioning at least one sealing device at a selected location along the wellbore; conveying a work string into the wellbore; using the work string to perform the one or more activities; extracting the work string out of the wellbore; and shifting the at least one sealing device to a closed position wherein a bore of the wellbore is sealed by using a portion of the work string. In one embodiment, the sealing device may include a first and a second sealing element. The method may further include sealing the bore with a first sealing element and a second sealing element; supporting a pressure applied in an uphole direction with the first sealing element; and supporting a pressure applied in a downhole direction with the second sealing element. In arrangements wherein the work string engages an engagement sleeve associated with the sealing device, the method may include pulling the engagement sleeve with the work string in an uphole direction to fold the first and second sealing elements. In aspects, the at least one sealing device may be shifted while the work string is being extracted from the wellbore. The method may include locking the sealing device in the closed position to maintain the seal in the wellbore. In aspects, the method may include unsealing the wellbore by shifting the sealing device to an open position. In arrangements, the method may further include applying a pressure cycle to shift the at least one sealing device to an open position. In arrangements, the pressure cycle may activate a hydraulic actuator coupled to the at least one sealing device. The hydraulic actuator may include a ratchet member, and applying the pressure cycle may incrementally move the ratchet member to shift the at least one sealing device.

In aspects, the present disclosure provides a system for use in a wellbore that includes a work string, a setting tool positioned on the work string, a first seal element and a second seal element positioned along the wellbore, and a mechanical actuator configured to move the seal elements between the open position and the closed position while engaged with the setting tool. The first seal element and the second seal element may have an open position that allows fluid communication along the wellbore and a closed position that prevents fluid communication along the wellbore. In embodiments, the mechanical actuator may include an engagement sleeve, a profile connected to the engagement sleeve, and a mandrel coupled to the sleeve. In arrangements, the engagement sleeve may be positioned uphole of the first and the second seal elements and the mandrel may be positioned downhole of the first and the second seal elements. In arrangements, the system may include a hinge element connecting each of the first and the second seal element to a housing, and the mandrel may rotate the first and the second sealing elements about their respective hinge elements. In aspects, the system may include a hydraulic actuator configured to shift the first and the second sealing element to an open position. The hydraulic actuator may include a ratchet member configured to incrementally move in response to an applied pressure.

In aspects, the present disclosure provides a system for selective occlusion of a bore of a wellbore tubular. The system may include a work string configured to be conveyed along the bore, a setting tool positioned on the work string, a first seal element positioned along the bore, a second seal element positioned along the bore, a mechanical actuator device configured to shift the seal elements to a closed position wherein the bore is occluded, and a hydraulic actuator configured to shift the seal elements to an open position wherein the bore is not occluded. The first seal element may be configured to selective occlude the bore and resist a pressure applied in a downhole direction and the second seal element may be configured to selectively occlude the bore and resist pressure applied in an uphole direction. The mechanical actuator may be configured to engage the setting tool. In arrangements, the mechanical actuator may include an engagement sleeve; a profile connected to the engagement sleeve, and a mandrel coupled to the engagement sleeve. The profile may be configured to receive the setting tool. In aspects, the engagement sleeve may be positioned uphole of the seal elements and the mandrel may be positioned downhole of the seal elements. In aspects, the hydraulic actuator is responsive to an applied pressure. In one arrangement, the hydraulic actuator may include a ratchet member configured to incrementally move in response to the applied pressure.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1A:
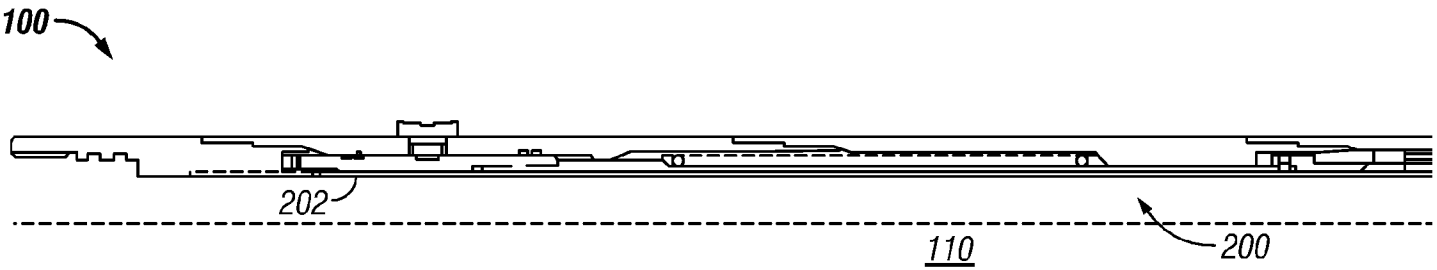
FIGS. 1A-1C schematically illustrates one embodiment of a sealing device made in accordance with the present disclosure.

The present disclosure relates to devices and methods for selectively sealing a bore of a wellbore tubular. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Indeed, as will become apparent, the teachings of the present disclosure can be utilized for a variety of well tools and in all phases of well construction and production. Accordingly, the embodiments discussed below are merely illustrative of the applications of the present disclosure.

Figure 1B:
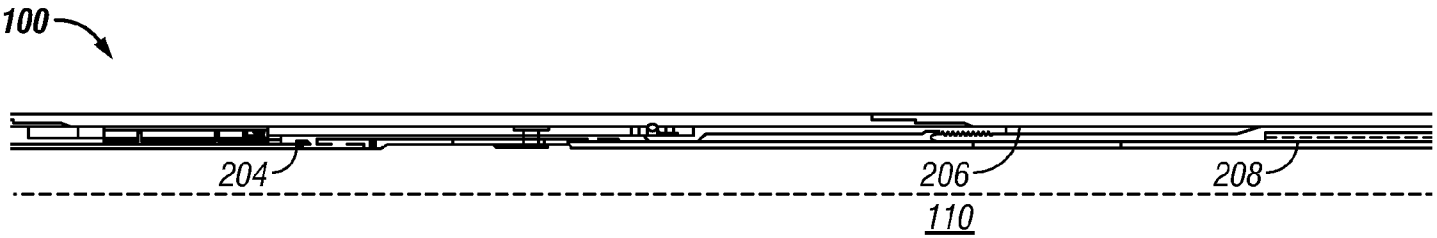
Figure 1C:
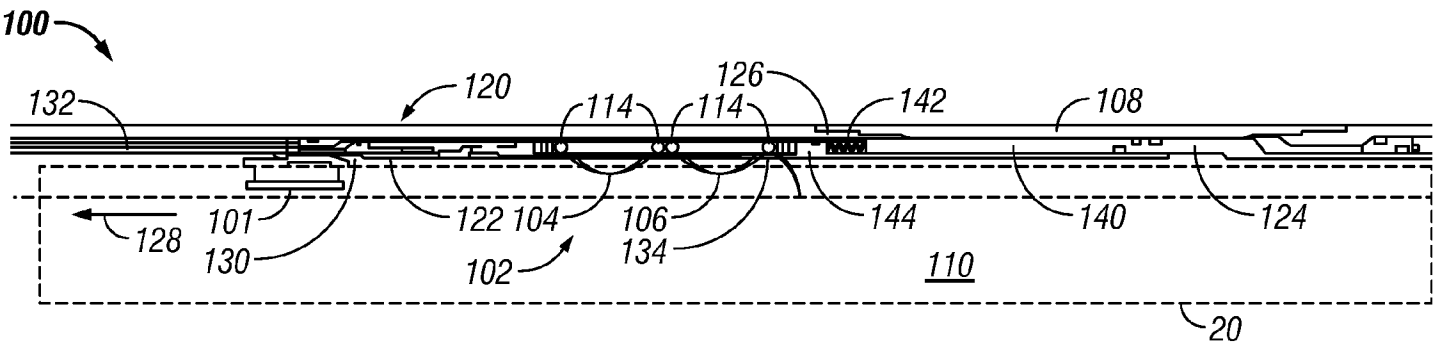

Referring initially to FIGS. 1A-C, there is schematically illustrated one embodiment of a sealing device 100 made in accordance with the present disclosure. In embodiments, the sealing device 100 may be used in conjunction with tubing conveyed wellbore equipment configured to perform one or more wellbore tasks. In certain illustrative embodiments, the tubing conveyed wellbore equipment may be configured to activate the sealing device 100 to seal off a bore of a wellbore tubular while the wellbore equipment is being actuated in the well. Thus, a separate activation step may not be required to cause the sealing device 100 to move to a sealed or closed position.

FIGS. 1A-C schematically illustrate one embodiment of a sealing device 100 for selectively sealing a bore of a wellbore tubular that includes a mechanical actuator 120 that initiates the sealing of the tubular bore and a hydraulic actuator 200 that may be operated to unseal the bore. Because the embodiment is generally tubular in form, the lower halves below the centerline have been omitted for clarity. FIG. 1A illustrates an upper section of the sealing device 100 that includes a piston assembly 202 associated with the hydraulic actuator 200. FIG. 1B, illustrates a middle section of the sealing device 100 that includes a ratcheting assembly 204 associated with the hydraulic actuator 200, a locking assembly 206 and biasing members 208. FIG. 1C illustrates a lower section that includes the seal assembly 102 and the seal mechanical actuator 120.

Referring now to FIG. 1C, during operation, a setting tool 101 associated with a work string 20 (shown in phantom) engages the mechanical actuator 120. The setting tool 101 may be integral with the work string 20 or a component that is mounted on the work string 20. This engagement causes the mechanical actuator 120 to shift the sealing device 100 into a sealed position in a bore 110 of a wellbore tubular. The locking assembly 206 locks the components of the sealing device 100 to keep the sealing device 100 in the sealed position. To unseal the bore, the hydraulic actuator 200 may be activated using a pressure cycle. For example, the pressure cycles may cause progressive movement within the ratcheting assembly 204 that eventually releases biasing members 208. The biasing members 208 apply a force that shift the seal mechanical actuator 120 to its original position, which thereby reopens the bore 110. These biasing members 208 may be compressed as the sealing device 100 is shifted to the sealed position. Exemplary embodiments are discussed in greater detail below.

Figure 2:
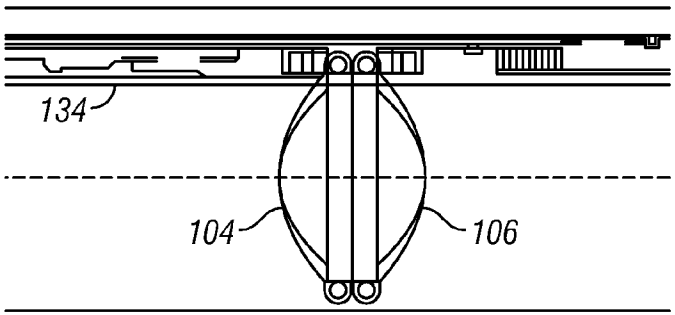
FIG. 2 schematically illustrates a closed position of an embodiment of seal elements made in accordance with the present disclosure.

Referring in particular to FIG. 1C, in embodiments, the seal assembly 102 may include one or more seal elements such as a first flapper element 104 and a second flapper element 106 positioned along a housing 108. The flapper elements 104, 106 may be formed as convex shells that, along with seals (not shown), can provide a barrier to fluid flow in a bore 110 of the housing 108. A relatively flat or disk-like shape may also be used for the flapper elements 104, 106. A flat shape may provide the same pressure resistance for either uphole or downhole applied pressure. The convex shape increases the pressure resistance for one of the two directions. For example, the convex shape for the flapper element 104 increases the pressure resistance for pressure in a downhole direction. In embodiments, the flapper elements 104, 106 may be coupled to one another and to the housing 108 with hinge elements 114. FIG. 1C shows the flapper elements 104, 106 in the open position and FIG. 2 shows the flapper elements 104, 106 in the closed position.

The mechanical actuator 120 may be used to collapse the flapper elements 104, 106 to seal the bore 110 and unfold the flapper elements 104, 106 to open the bore 110. In one embodiment, the mechanical actuator 120 may include an engagement sleeve 122 that is configured to receive the setting tool 101, a lower mandrel 124, and a connector 126 that connects the engagement sleeve 122 with the lower mandrel 124. These elements may be generally tubular in form and concentrically or telescopically arranged. The term "mechanical" generally refers to an arrangement wherein the elements or components of the actuator co-act physically (e.g., via motion and physical contact) rather than electrically or hydraulically. Generally speaking, during operation, the setting tool 101 engages the engagement sleeve 122 and pulls the engagement sleeve 122 in an uphole direction shown by arrow 128. The lower mandrel 124 will also move in the uphole direction due to the fixed relationship between the lower mandrel 124 and the engagement sleeve 122. This axial translation of the lower mandrel 124 applies an axial loading on the flapper elements 104, 106. When the axial loading is of a sufficient magnitude, the flapper elements 104, 106 rotate or pivot about the hinge elements 114 and assume a generally transverse orientation in the bore 110 to form the fluid flow barrier (see FIG. 2).

The engagement sleeve 122 may include a profile 130 shaped to receive the setting tool 101. That is, the profile 130 may have a contour, cavity, shoulder or recess that engages a complementary region on the setting tool 101. The profile 130 may be a finger or other structure that is coupled to and slides along a longitudinal slot 132 formed in the engagement sleeve 122. Initially, the profile 130 is at a lower most position along the longitudinal slot 132. This initial movement causes a protective sleeve 134 to slide away from the flapper elements 104, 106. The sleeve 134 may be used to shield the flapper elements 104, 106 from contact with tooling or equipment that may be traveling along the bore 110. The setting tool 101, upon engagement, pulls the profile 130 into an upper most position along the slot 132. Thereafter, the setting tool 101 and the profile 130 cooperate to pull the engagement sleeve 122 in the uphole direction.

The lower mandrel 124 may include a first translating element 140, biasing elements 142, and a second translating element 144. The connector 122 may connect the engagement sleeve 122 to the first translating element 144. During operation, the uphole movement of the first translating element 140 applies a pressure that compresses the biasing elements 142. After the biasing elements 142 have been mostly or fully compressed, the first translating element 140 displaces the second translating element 144 in the uphole direction.

Figure 3A:
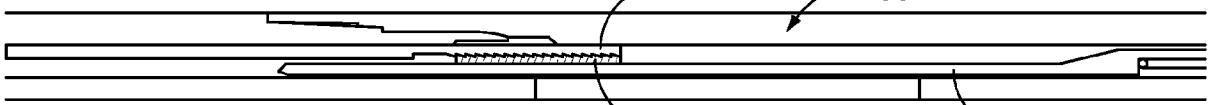
FIGS. 3A and 3B schematically illustrates one embodiment of a locking assembly made in accordance with the present disclosure.
Figure 3B:
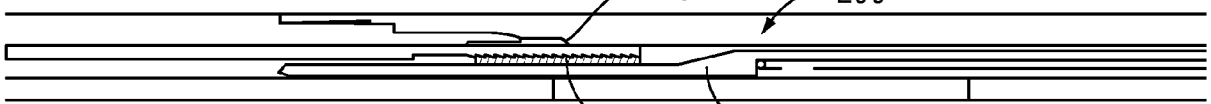
Figure 4:
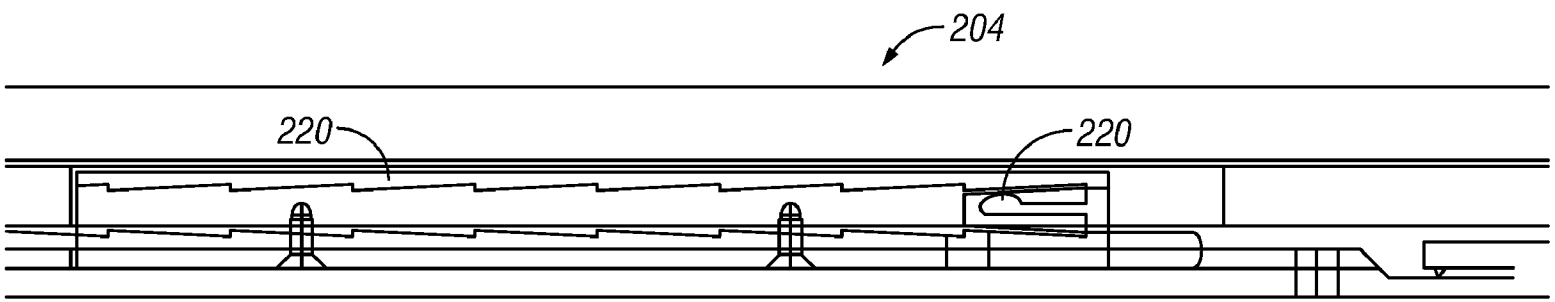
FIG. 4 schematically illustrates one embodiment of an indexing assembly made in accordance with the present disclosure.

Uphole movement of the second translating element 144 causes the flapper elements 104, 106 to fold about their respective hinge elements 114. The flapper elements 104, 106 may be locked in the sealed or closed position (FIG. 2) using the locking assembly 206. Referring now to FIGS. 3A-B, there is shown one embodiment of the locking assembly 206 that includes two rows of interlocking teeth 210 and 212. In FIG. 3A, there is shown in greater detail the pre-activation position of an inner tubular 214 on which the lower teeth 212 are formed. In FIG. 3B, the inner tubular 214 has been moved uphole by the movement of the setting tool 101. The rake or angle of the teeth 210 and 212 allow the uphole movement of the inner tubular 214, but the interlocking action of the teeth 210 and 212 prevent the inner tubular 214 from sliding back downhole. Additionally, a lock ring or other suitable element (not shown) may be used to maintain the sealing device 100 in the sealed position. Also, in embodiments, the protective sleeve 134 may be translated into a buttressing engagement with the flapper 104 as shown in FIG. 2 to further secure the sealed position of the sealing device 100.

As described previously, the hydraulic actuator 200 may be used to reopen the bore 100. In one embodiment, the hydraulic actuator 200 uses the biasing elements 208 to apply a downhole directed force along the actuating device 120 that causes the sealing device 100 to return to the original open position. In certain arrangements, the hydraulic actuator 160 may be configured to be responsive to pressure cycles. For example, an increase in pressure may be used to actuate the piston arrangement 202 (FIG. 1A). In response to applied pressure, the piston arrangement 202 may cause progressive movement within a ratchet device 204. For instance, the piston arrangement 202 (FIG. 1A) may incrementally move an index element 220 across a row of teeth 222. Upon traveling a prescribed length along the row of teeth 222, the index element 220 may deactivate the locking element. Deactivating the locking element releases the biasing elements 208, which then apply a downward force that causes the lower mandrel 140 (FIG. 1C) to slide downhole and pull apart the flapper elements 104, 106.

Figure 5:
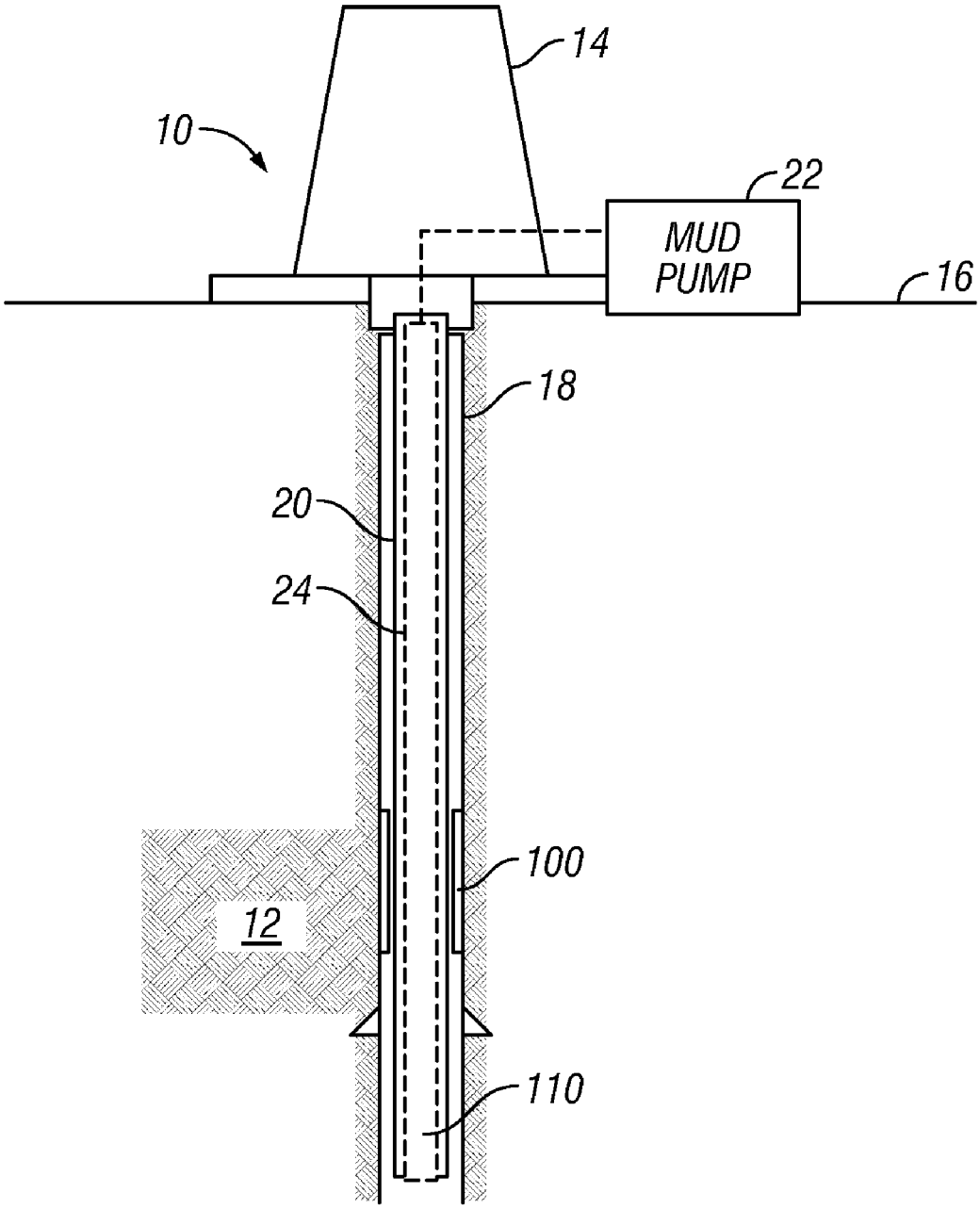
FIG. 5 schematically illustrates a well system adapted to utilize embodiments of the present disclosure.

Referring now to FIG. 5, there is shown a well construction facility 10 positioned over a subterranean formation 12. While the facility 10 is shown as land-based, it can also be located offshore. The facility 10 can include known equipment and structures such as a derrick 14 at the earth's surface 16, a casing 18 in a wellbore 20, and mud pumps 22. One or more wellbore tubulars 24 may be suspended within the wellbore 20. A suitable telemetry system (not shown) can be known types as mud pulse, electrical signals, acoustic, or other suitable systems. The particular equipment present at the facility 10 and in the wellbore 20, of course, depends on a number of factors, e.g., whether the well is land or offshore, whether the well is being drilled, competed, or worked over, etc.

In certain arrangements, a work string 24, which may include jointed tubulars, drill pipe, coiled tubing, etc., may be used to convey one or more well tools into the wellbore 20 and/or to perform one or more wellbore activities, which may include but are not limited to activities associated with the completion, recompletion, or workover of the well. These activities may involve the pumping of a fluid from the surface to a selected location in the wellbore. Exemplary activities may include cementing, gravel packing, fracturing, chemical treatment, etc. One aspect or step of such an activity may be the sealing off one or more sections of the bore. Sealing the bore may be required to, for example, perform pressure tests of seals along the tubular 24 or activate hydraulically actuated tools. Thus, one or more sealing devices 100 may be positioned along the wellbore 20.

Referring now to FIGS. 1A-C and 5, in one mode of operation, a setting tool 101 is positioned along the work string 24 and the work string 24 into the wellbore. Thereafter, fluids may be pumped along the work string 24 or the work string 24 may be manipulated to perform one or more specified activities. After the activities are completed, the work string 24 is pulled out of the well. During the uphole movement, the setting tool 101 engages the profile 130 of the engagement device as shown in FIG. 1C. In a manner previously described, the flapper elements 104, 106 fold and seal off the bore 110. Thereafter, the pressure uphole of the flapper elements 104, 106 may be increased as desired. After the procedures requiring the increase of pressure uphole of the flapper elements 104, 106 have been completed, it may be desired to reopen the bore 110. In one arrangement, the pressure in the bore 110 is increased in a cyclical fashion. Each pressure increase moves the index element one step. Thus, say after eight cycles, the index element has completed its travel along the track and triggers the release of the biasing elements. The biasing elements cause the lower mandrel 140 to move in the downhole direction, which causes the flapper elements 104, 106 to unfold. The protective sleeve 134 may also be reinserted under the flapper elements 104, 106. Thus, the bore 110 has been reopened.

Thus, it should be appreciated that what has been described includes, in part, a method of performing one or more wellbore-related activities, one embodiment of which includes positioning at least one sealing device at a selected location along the wellbore; conveying a work string into the wellbore; using the work string to perform the one or more activities; extracting the work string out of the wellbore; and shifting the at least one sealing device to a closed position by using a portion of the work string. The bore of the wellbore is sealed when the at least one sealing device is in the closed position. In one embodiment, the sealing device may include a first and a second sealing element. In such embodiments, the method may include sealing the bore with a first sealing element and a second sealing element; supporting a pressure applied in an uphole direction with the first sealing element; and supporting a pressure applied in a downhole direction with the second sealing element. In arrangements wherein the work string engages an engagement sleeve associated with the sealing device, the method may include pulling the engagement sleeve with the work string in an uphole direction to fold the first and second sealing elements. In aspects, the at least one sealing device may be shifted while the work string is being extracted from the wellbore. The method may include locking the sealing device in the closed position to maintain the seal in the wellbore. In aspects, the method may include unsealing the wellbore by shifting the sealing device to an open position. In arrangements, the method may further include applying a pressure cycle to shift the at least one sealing device to an open position. In arrangements, the pressure cycle may activate a hydraulic actuator coupled to the at least one sealing device. The hydraulic actuator may include a ratchet member, and applying the pressure cycle may incrementally move the ratchet member to shift the at least one sealing device.

It should also be appreciated that what has been described includes, in part, a system for use in a wellbore that includes a work string, a setting tool positioned on the work string, a first seal element and a second seal element positioned along the wellbore, and a mechanical actuator configured to move the seal elements between the open position and the closed position while engaged with the setting tool. The first seal element and the second seal element may have an open position that allows fluid communication along the wellbore and a closed position that prevents fluid communication along the wellbore. In embodiments, the mechanical actuator may include an engagement sleeve, a profile connected to the engagement sleeve, and a mandrel coupled to the sleeve. In arrangements, the engagement sleeve may be positioned uphole of the first and the second seal elements and the mandrel may be positioned downhole of the first and the second seal elements. In arrangements, the system may include a hinge element connecting each of the first and the second seal element to a housing, and the mandrel may rotate the first and the second sealing elements about their respective hinge elements. In aspects, the system may include a hydraulic actuator configured to shift the first and the second sealing element to an open position. The hydraulic actuator may include a ratchet member configured to incrementally move in response to an applied pressure.

It should be further appreciated that what has been described includes, in part, a system for selective occlusion of a bore of a wellbore tubular. The system may include a work string configured to be conveyed along the bore, a setting tool positioned on the work string, a first seal element positioned along the bore, a second seal element positioned along the bore, a mechanical actuator device configured to shift the seal elements to a closed position wherein the bore is occluded, and a hydraulic actuator configured to shift the seal elements to an open position wherein the bore is not occluded. The first seal element may be configured to selective occlude the bore and resist a pressure applied in a downhole direction and the second seal element may be configured to selectively occlude the bore and resist pressure applied in an uphole direction. The mechanical actuator may be configured to engage the setting tool. In arrangements, the mechanical actuator may include an engagement sleeve; a profile connected to the engagement sleeve, and a mandrel coupled to the engagement sleeve. The profile may be configured to receive the setting tool. In aspects, the engagement sleeve may be positioned uphole of the seal elements and the mandrel may be positioned downhole of the seal elements. In aspects, the hydraulic actuator is responsive to an applied pressure. In one arrangement, the hydraulic actuator may include a ratchet member configured to incrementally move in response to the applied pressure.

The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

The invention claimed is:

1. A method of performing one or more activities in a wellbore, comprising:

using a work string to perform the one or more activities in the wellbore;

sealing a tool bore of a tool in the wellbore by shifting at least one sealing device to a closed position by engaging a portion of the work string in the tool bore with the at least one sealing device, wherein the sealing device includes a first and a second sealing element coupled to one another and wherein the tool bore is sealed with the first sealing element and the second sealing element;

supporting a pressure applied in an uphole direction with the first sealing element;

supporting a pressure applied in a downhole direction with the second sealing element; and folding the first and second sealing elements by pulling an engagement sleeve associated with the sealing device with the work string in an uphole direction.

2. The method of claim 1 wherein the at least one sealing device is shifted while the work string is being extracted through the tool bore.

3. The method of claim 1 further comprising locking the sealing device in the closed position to maintain the seal in the wellbore.

4. The method of claim 1 further comprising unsealing the wellbore by shifting the sealing device to an open position.

5. A method of performing one or more activities in a wellbore, comprising:

using a work string to perform the one or more activities in the wellbore;

sealing a tool bore of a tool in the wellbore by shifting at least one sealing device to a closed position by engaging a portion of the work string in the tool bore with the at least one sealing device, the at least one sealing device having at least two sealing elements coupled to one another; and applying a pressure cycle to shift the at least one sealing device to an open position to unseal the wellbore, wherein the pressure cycle activates a hydraulic actuator coupled to the at least one sealing device.

6. The method of claim 5 wherein the hydraulic actuator includes a ratchet member, and wherein applying the pressure cycle incrementally moves the ratchet member to shift the at least one sealing member.

7. A system for use in a wellbore, comprising:

a first seal element and a second seal element associated with a tool having a tool bore positioned along the wellbore, the first seal element and the second seal element being coupled to one another and configured to close the tool bore along the wellbore;

a mechanical actuator configured to move the first and the second seal element, wherein the mechanical actuator includes an engagement sleeve and a profile connected to the engagement sleeve, and wherein the engagement sleeve is positioned uphole of the first and the second seal elements;

a work string configured to move through the tool bore;

a setting tool positioned on the work string and configured to engage the mechanical actuator, the profile being configured to receive the setting tool in the tool bore; and a mandrel coupled to the engagement sleeve, the mandrel being positioned downhole of the first and the second seal elements.

8. The system of claim 7 further comprising a hinge element connecting each of the first and the second seal element to a housing, a mandrel coupled to the engagement sleeve, wherein the mandrel is configured to rotate the first and the second sealing elements about their respective hinge elements.

9. A system for use in a wellbore, comprising:

first seal element and a second seal element associated with a tool having a tool bore positioned along the wellbore, the first seal element and the second seal element being coupled to one another and configured to close the tool bore along the wellbore;

a mechanical actuator configured to move the first and the second seal element;

a work string configured to move through the tool bore;

a setting tool positioned on the work string and configured to engage the mechanical actuator; and a hydraulic actuator configured to shift the first and the second sealing element to an open position.

10. The system of claim 9 wherein the hydraulic actuator includes a ratchet member configured to incrementally move in response to an applied pressure.

* * * * *